US005800295A

United States Patent [19]

Rogitz

[11] Patent Number: 5,800,295

[45] Date of Patent: Sep. 1, 1998

[54] AUTOMATICALLY LOWERING BASKETBALL HOOP FOR DUNKING

[76] Inventor: John Mark Rogitz, 8857 Los Coches Rd., Lakeside, Calif. 92040

[21] Appl. No.: 820,569

[22] Filed: Mar. 19, 1997

[51] Int. Cl.[6] ..... A63B 63/08

[52] U.S. Cl. ..... 473/483

[58] Field of Search ..... 473/483; 200/86.5, 200/DIG. 23, DIG. 36; 250/221

[56] References Cited

U.S. PATENT DOCUMENTS

| | | | |
|---|---|---|---|
| 2,946,931 | 7/1960 | Durbin | 250/221 X |
| 3,419,188 | 12/1968 | Matchett | 250/221 X |
| 3,586,324 | 6/1971 | Bearson | 473/484 |
| 4,497,989 | 2/1985 | Miller | 200/86.5 X |
| 4,951,944 | 8/1990 | Morgan | 473/483 |

*Primary Examiner*—William H. Grieb
*Attorney, Agent, or Firm*—John L. Rogitz

[57] ABSTRACT

A basketball apparatus includes a base and a vertically reciprocating mechanism on the base. A hoop support is connected to the mechanism, such that motion of the mechanism causes motion of the hoop support. Also, a basketball hoop is attached to the hoop support, and an actuator pad is in communication with the mechanism such that the pad, when stepped on by a person driving to the hoop, activates the mechanism to thereby lower the hoop and facilitate a dunk.

10 Claims, 3 Drawing Sheets

122
124
126
134
120
100
112
106
104
102a
128
130
114
132
108
140
118
147
138
136
110
148
146
144
102
142
109

AUTOMATICALLY LOWERING BASKETBALL HOOP FOR DUNKING

FIELD OF THE INVENTION

The present invention relates generally to sports equipment, and more particularly to basketball hoops.

BACKGROUND

Basketball is a popular sport, particularly among young people. Not only is it challenging and fun to shoot baskets, but it is likewise challenging and fun to execute "moves" to the basket past one's opponents and dunk the ball.

It happens that for most people, and especially young players, it is difficult if not impossible to dunk a basketball on a regulation hoop, which is disposed ten feet above the ground. Accordingly, adjustable-height basketball stands have been provided that can be configured to be shorter than regulation stands, and these devices can be used by smaller children to play basketball, and by older players such as teenagers to dunk the basketball.

As recognized by the present invention, however, while it is challenging and fun for players to execute dunks on shorter basketball stands, it is desirable that the hoop be positioned back at the regulation ten foot height when the players shoot the basketball toward the hoop. Otherwise, the players' timing and aim will be deleteriously affected when the players shoot at regulation hoops. Unfortunately, stopping play while manually lowering and raising an adjustable stand is time consuming and, more importantly, disrupts the flow of the game. Accordingly, the present invention recognizes a need to provide a basketball stand that provides for quickly lowering a basketball hoop during play, to facilitate dunking, and that easily resets to a predetermined regulation height after the dunk.

It is therefore an object of the present invention to provide an adjustable basketball stand having a hoop that can be disposed at more than one height above the base of the stand. Another object of the present invention is to provide an adjustable basketball stand having a hoop that can be moved rapidly downwardly during play to facilitate dunking. Still another object of the present invention is to provide an adjustable basketball stand that is easy to use and cost-effective.

SUMMARY OF THE INVENTION

A basketball apparatus includes a base, a vertically reciprocable mechanism on the base, and a hoop support connected to the mechanism. Motion of the mechanism causes motion of the hoop support. A basketball hoop is attached to the hoop support, and an actuator having at least a portion distanced from the base and the mechanism is in communication with the mechanism. With this structure, the actuator is activatable by a person to activate the mechanism to thereby lower the hoop.

In a preferred embodiment, the mechanism includes a motor. Alternatively, the mechanism can include at least one spring. Further, the portion of the actuator that is distanced from the base is a pad positionable on the ground such that a person can step on the pad to generate a signal to activate the mechanism. Alternatively, the actuator includes a light detector and a light source, with one of the source and detector being distanced from the base. In this embodiment, a person can interrupt a line of sight between the source and detector to thereby generate a signal to activate the mechanism.

In another aspect, a basketball stand includes a base, a basketball hoop, and a mechanism reciprocably engaged with the base and coupled to the hoop. An actuating element is distanced from the base, and the actuating element communicates with the mechanism to activate the mechanism to cause the hoop to move downwardly.

In yet another aspect, a method for honing basketball skills includes the steps of providing a basketball hoop on a mechanism that is movable in the vertical dimension such that the hoop can be moved by the mechanism between a standard height and a dunk height lower than the standard height. The method further includes providing an actuating element distanced from the mechanism and in communication therewith. With the hoop at the standard height, the method includes shooting a basketball toward the hoop. Then, the method includes driving toward the hoop while activating the actuating element to cause the hoop to quickly lower to the dunk height and thereby facilitate a dunk.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
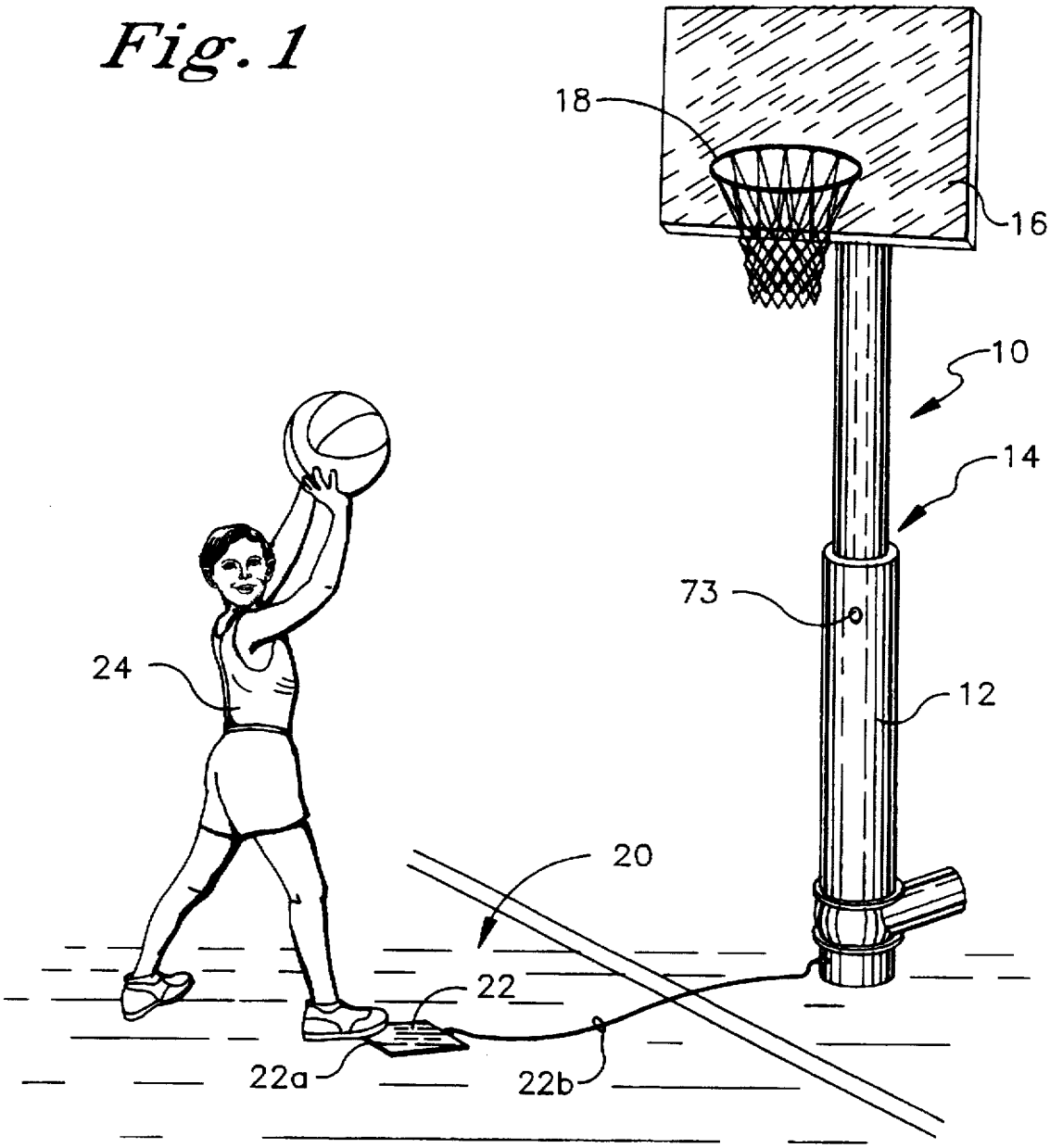
FIG. 1 is a perspective view of the basketball stand of the present invention that uses a stepper motor as the operating mechanism that moves the hoop.

Referring initially to FIG. 1, a basketball apparatus, generally designated 10, is shown which includes a base 12, a vertically reciprocable mechanism, generally designated 14, on the base 12, and a hoop support 16 connected to the mechanism 14, such that motion of the mechanism 14 causes motion of the hoop support 16. A basketball hoop 18 attached to the hoop support 16.

An actuator, generally designated 20, having at least a portion, such as a pad 22, that is distanced from the base 12 and the mechanism 14, is in communication with the mechanism 14. Per the present invention, the actuator 20 is activatable by a person 24 to activate the mechanism 14 to thereby lower the hoop 18. Preferably, the pad 22 is covered by hard-wearing plastic or rubber, and includes an embedded electrical switch **22*a* (shown schematically in FIG. 1) that generates a signal and sends the signal to the motor in the base 12 as more fully disclosed below via an insulated line 22*b***.

Figure 3:
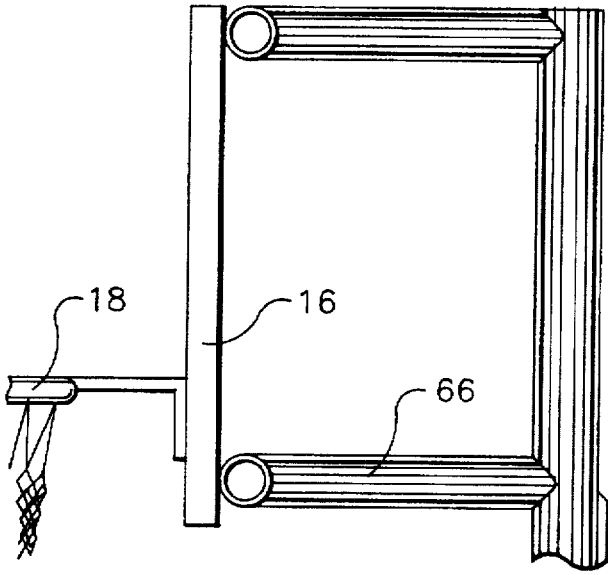
FIG. 3 is a cross-sectional view as seen along the 3—3 in FIG. 2.
Figure 3:
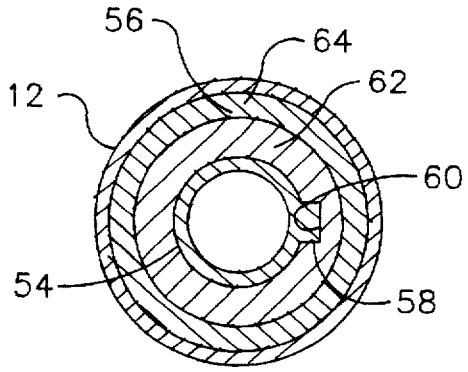
Figure 2:
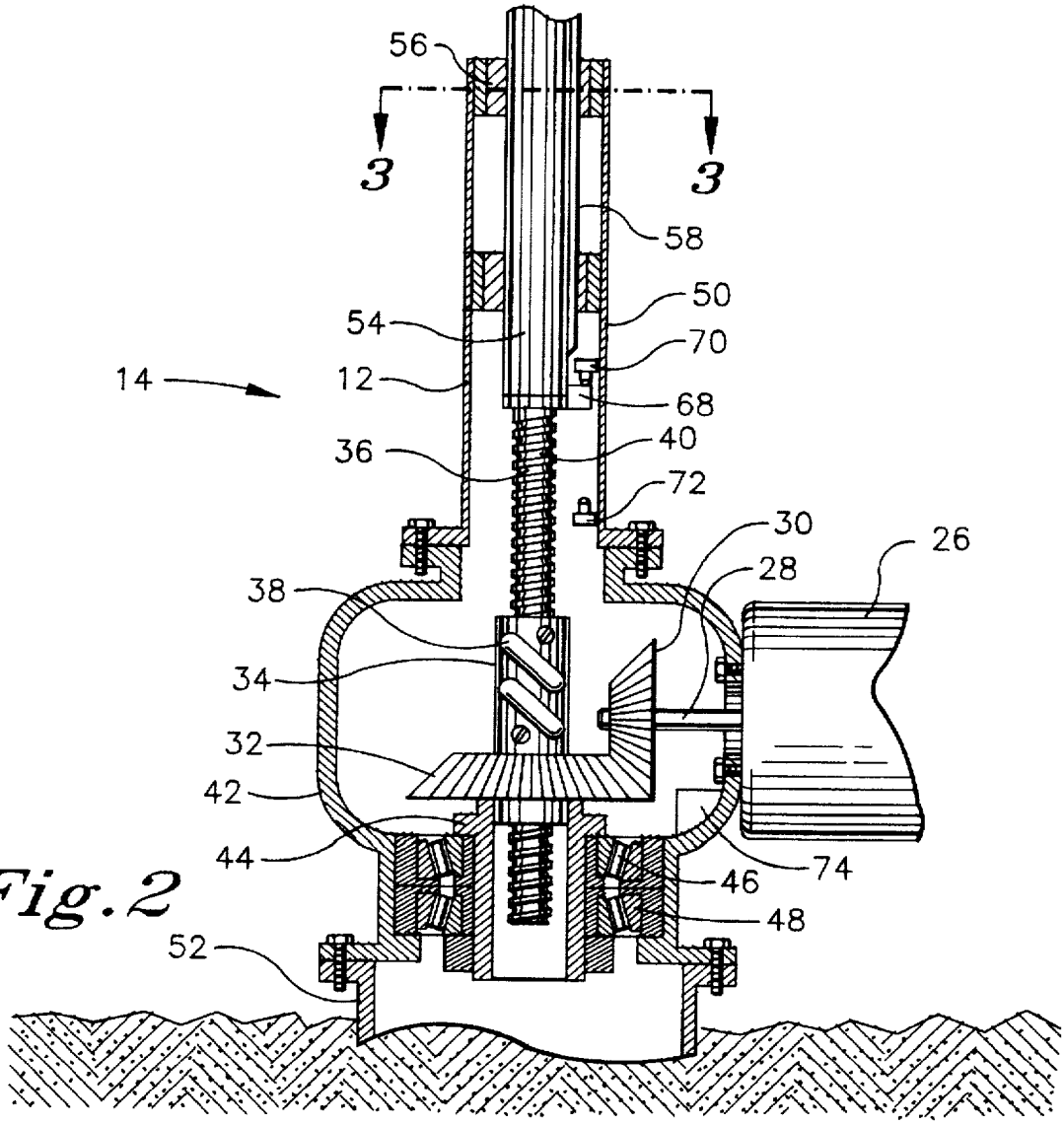
FIG. 2 is a partial cross-sectional view of the stand shown in FIG. 1, with portions shown in phantom and portions broken away, and with the hoop in the standard position.

In cross-reference to FIGS. 2 and 3, the mechanism 14 includes a motor 26. In one embodiment, the motor 26 is a stepper motor. It is to be understood that the motor 26 can be energized via an ac socket and ac-dc converter in accordance with principles well known in the art. Or, the motor 26 can be battery powered. The portion of the base 12 that holds the motor 26 can be buried underground, so that only the vertically moving pole is above ground.

As shown in FIG. 2, the motor 26 turns a shaft 28 that in turn rotates a motor bevel gear 30. The motor bevel gear 30 is meshed with a screw bevel gear 32, it being readily understood in reference to FIG. 2 that the bevel gear arrangement disclosed above translates rotational motion of the shaft 28 about a horizontal axis to rotational motion about a vertical axis.

A ball housing 34 is fixedly attached to the screw bevel gear 32, such that rotation of the screw bevel gear 32 causes rotation of the ball housing 34. Furthermore, an elongated, vertically-oriented screw 36 is coaxially disposed within the ball housing 34 as shown. Plural balls 38 are disposed within the ball housing 34 and the balls 38 are constrained to ride within the housing 34 in the helical groove 40 that is established by the screw 36.

FIG. 2 shows that the base 12 includes a gear enclosure 42 in which the bevel gears 28, 32 are disposed. Also, a thrust collar 44 is disposed in the enclosure 42 concentrically around the screw 36, such that the screw 36 rotates relative to the thrust collar 44 with the screw bevel gear 32 being supported by the thrust collar 44. Axial thrust induced in the screw 36 is absorbed by a thrust bearing 46 having plural thrust shoes 48, with the thrust bearing 46 being engaged with the thrust collar 44 in accordance with thrust absorption principles known in the art. The gear enclosure 42 is bolted as shown to upper and lower base segments 50, 52, and the lower base segment 52 is anchored in the ground by suitable means, e.g., cement.

Moreover, a sleeve 54 is attached to the screw 36 to protect and partially enclose the screw 36, and the sleeve 54 extends upwardly above the top of the screw 36. One or more single- or double-ring radial bearings 56 are sandwiched between the base 12 and sleeve to radially support the sleeve 54.

In brief cross-reference to FIGS. 2 and 3, a vertical rib 58 is formed on the sleeve 54, and the rib 58 is slidably engaged with a vertical groove 60 formed in an inner ring 62 of one of the radial bearings 56 to thereby prevent rotational motion of the sleeve 54 and, hence, screw 36. As shown, the radial bearing 56 is a two-ring bearing that also includes an outer ring 64.

With the above disclosure in mind, it may now be appreciated that the cooperation between the ball housing 34, balls 38, screw 36, and sleeve 54 with its rib 58 constrained in the grooves 60 of the radial bearings 56 converts rotational motion of the ball housing 34 to translational motion of the screw 36 (and, hence, sleeve 54) in the vertical dimension. Moreover, because the sleeve 54 is in turn connected to the hoop support 16 via horizontal stanchions 66, the hoop 18 is caused to move vertically by the mechanism 14 just described when the motor 26 is activated.

To indicate the position of the hoop 18, a contact 68 protrudes radially outwardly from the sleeve 54 to operate as described below. In the standard height position shown, the contact 68 abuts an upper limit switch 70 in the base 12 to generate a signal representative of the standard height position. When the hoop 18 is in the standard height position, the pad 22 (FIG. 1) is enabled, and a person can step on the pad 22 to energize the motor 26 (FIG. 2) to quickly lower the hoop 18 to the dunk position as the person continues his or her drive to the hoop. The gear ratios of the bevel gears 30, 32 and the speed of the motor 26 are established to effect relatively quick motion of the hoop 18, e.g., two feet per second.

When the hoop 18 has reached the dunk position, the contact 68 abuts a lower limit switch 72 in the base 12 to generate a signal representative of the dunk position. Upon receipt of this signal, the motor 26 is deactivated. The person 24 may then manipulate a reset switch 73 (FIG. 1) to reverse the motor 26 and activate the motor 26 to raise the hoop back to the standard position, as indicated by the upper limit switch 70. Or, a timer 74 can be disposed in the base 12 and electrically connected to the motor 26 to cause the motor 26 to raise the hoop 18 back to the standard position after a predetermined time period, e.g., fifteen seconds, has elapsed since the pad 22 was stepped on.

Figure 4:
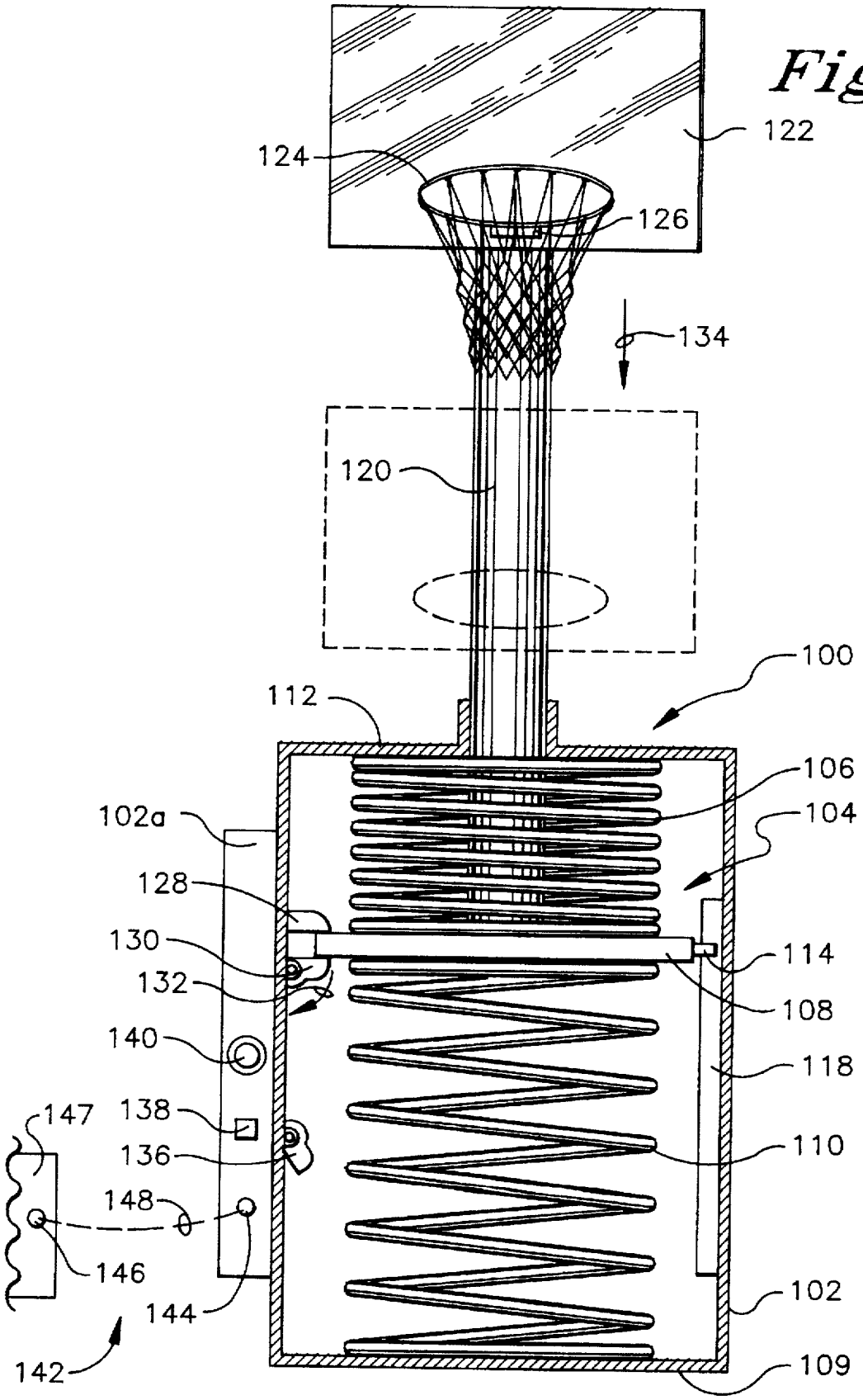
FIG. 4 is a schematic view of an alternate embodiment, which incorporates a spring mechanism to move the hoop, with the hoop shown in the dunk position in phantom.

Now referring to FIG. 4, a basketball apparatus, generally designated 100, is shown which includes a hollow plastic or metal base 102 that supports and encloses a vertically reciprocable mechanism, generally designated 104. As shown, the mechanism 104 includes a top spring 106 attached to the top surface of a disc-shaped horizontally-oriented flange 108, and a bottom spring 110 attached to the lower surface of the lower flange 108 and to a bottom 109 of the base 102. As shown, the top spring 106 is also attached to a top cover 112 of the base 102. These attachments can be effected by bolting or welding or other suitable means known in the art. If desired, the flange 108 can include a guide protrusion 114 that is slidably engaged with one or more channel-like elongated vertical guide rails 118 on the base 102.

A hoop support 120 including a basketball backboard 122 is connected to the mechanism 104, such that motion of the mechanism 104 causes motion of the hoop support 120. In turn, a basketball hoop 124 is attached, via a hoop heel 126, to the hoop support 120.

With the above connections between the mechanism 104 and the hoop 124 in mind, FIG. 4 shows how the mechanism 104 operates to move the hoop 124 from a standard height position (preferably ten feet above the ground), shown in solid in FIG. 4, to a lower, dunk height, shown in phantom. It is to be understood that the principles of the present invention can be applied to arrive at an apparatus which can hold the hoop 124 at more than two heights.

In the standard height position, the top flange 112 is sandwiched between a top stop 128 that is fixedly attached to the base 102 and an intermediate stop 130 that is pivotably attached to the base 102, with the top spring 106 in compression and the bottom spring 110 in tension.

When the actuator described below is activated, the intermediate stop 130 is released by an electrically-controlled lock (not shown) that is mounted in an electronics housing **102*a* of the base 102 to pivot downwardly in the direction indicated by the arrow 132. The lock mechanism can be any suitable device that is conventional in the electric lock art. When the intermediate stop 130 pivots downwardly, the springs 106, 110 cooperate to move the flange 108 (and, hence, the hoop 124) downwardly, in the direction indicated by the arrow 134, toward the dunk position shown in phantom in FIG. 4**.

To hold the hoop 124 in the dunk position, a lower stop 136 which is in all essential respects identical to the intermediate stop 130 pivots upwardly to a horizontal orientation after the lower flange 108 passes below the lower stop 136. The lock associated with the lower stop 136 causes the lower stop 136 to pivot as described moments after the intermediate stop 130 is released, such that the lower flange 108 has had sufficient time to move past the lower stop 136 but not sufficient time to rebound back upwardly past the stop 136.

It may now be appreciated that with the above-described cooperation of structure, the lower stop 136 contacts the upper surface of the lower flange 108 as the lower flange 108 is urged back upwardly, on the rebound, by the springs 106, 110. The hoop 124 is thus held in the dunk position. The spring constants of the springs 106, 110 are selected as appropriate for the particular size and weight of the mechanism 104 to effect the above-described operation.

In accordance with the present invention, the hoop 124 can be moved back to the standard position by one of two processes. A timer 138 can be mounted on the electronics housing 102*a* and connected to the intermediate and lower stops 130, 136 for causing the intermediate and lower stops 130, 136 to operate oppositely as described above, after a predetermined period (e.g., ten seconds) has elapsed from when the hoop 124 was moved to the dunk position. More specifically, after the hoop 124 has been in the dunk position for the predetermined period, the timer can cause the electronic lock associated with the lower stop 130 to release upwardly, thereby allowing the springs 106, 110 to cooperate to push the hoop 124 upwardly toward the standard position. When the upper flange 112 abuts the upper stop 128, the intermediate stop 130 is caused to pivot upwardly, opposite the direction indicated by the arrow 132.

Alternatively, the timer 138 can be disabled once the hoop 124 is in the dunk position. In this alternative embodiment, to move the hoop 124 back to the standard position, a person can manipulate a control button 140 which is coupled to the stops 130,136 to cause the stops 130, 136 to operate as described above.

FIG. 4 shows that the actuator of the alternate embodiment can include at least a portion distanced from the base 102 and the mechanism 104 but in communication with the mechanism 104 to activate the mechanism 104 to thereby move the hoop 124. More specifically, the apparatus 100 can include an actuator, generally designated 142, that includes a light detector 144 on the electronics housing 102*a*, and a light source 146 distanced from the base 102. The light source 146 can be battery-powered and mounted by means well-known in the art on a surface 147. It can be appreciated in reference to FIG. 4 that a person can interrupt a line of sight 148 between the source 146 and detector 144 to thereby generate a signal to activate the mechanism 104.

While the particular AUTOMATICALLY LOWERING BASKETBALL HOOP FOR DUNKING as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims.

What is claimed is:

1. A basketball apparatus, comprising:

a base;

a vertically reciprocable mechanism on the base;

a hoop support connected to the mechanism, such that motion of the mechanism causes motion of the hoop support;

a basketball hoop attached to the hoop support; and an actuator having at least a portion distanced from the base and the mechanism, the actuator being in communication with the mechanism, the actuator being activatable by a person to activate the mechanism to thereby lower the hoop, wherein the portion of the actuator distanced from the base is a pad positionable on the ground such that a person can step on the pad while driving toward the hoop to generate a signal to activate the mechanism and thereby lower the hoop as the person is driving toward the hoop to facilitate dunking.

2. The apparatus of claim 1, wherein the mechanism includes a motor.

3. The apparatus of claim 1, wherein the mechanism includes at least one spring.

4. The apparatus of claim 1, wherein the actuator includes a light detector and a light source, one of the source and detector being distanced from the base, wherein a person can interrupt a line of sight between the source and detector to thereby generate a signal to activate the mechanism.

5. A basketball stand, comprising:

a base;

a basketball hoop;

a mechanism reciprocably engaged with the base and coupled to the hoop;

an actuating element distanced from the base and communicating with the mechanism for activating the mechanism to cause the hoop to move downwardly, the actuating element including a pad Positionable on the ground such that a person can step on the pad while driving toward the hoop to generate a signal to activate the mechanism to thereby lower the hoop and facilitate dunking.

6. The basketball stand of claim 5, further comprising a hoop support connected to the mechanism, such that motion of the mechanism causes motion of the hoop support, the hoop support holding the hoop.

7. The basketball stand of claim 6, further comprising an actuator, the actuator including the actuating element, the actuator being activatable by a person to activate the mechanism to thereby lower the hoop.

8. The stand of claim 7, wherein the mechanism includes a motor or at least one spring.

9. The stand of claim 7, wherein the actuator includes a light detector and a light source, one of the source and detector being distanced from the base, wherein a person can interrupt a line of sight between the source and detector to thereby generate a signal to activate the mechanism.

10. A method for honing basketball skills, comprising the steps of:

providing a basketball hoop on a mechanism movable in the vertical dimension such that the hoop can be moved by the mechanism between a standard height and a dunk height lower than the standard height;

providing an actuating element with a sensor distanced from the mechanism and in communication therewith;

with the hoop at the standard height, shooting a basketball toward the hoop; and driving toward the hoop while activating the actuating element by driving toward the hoop to cause the hoop to quickly lower to the dunk height and thereby facilitate the dunk.

* * * * *